US005877671A

United States Patent [19]

Hofsäss

[11] Patent Number: 5,877,671

[45] Date of Patent: Mar. 2, 1999

[54] TEMPERATURE CONTROLLER HAVING A POLYIMIDE FILM

[76] Inventor: Marcel Hofsäss, Bodelschwinghstrasse 36, 75179 Pforzheim, Germany

[21] Appl. No.: 874,514

[22] Filed: Jun. 13, 1997

[30] Foreign Application Priority Data

Jun. 13, 1996 [DE] Germany ..... 196 23 570.7

[51] Int. Cl.[6] ..... H01H 37/54; H01H 37/74; H01H 37/02

[52] U.S. Cl. ..... 337/343; 337/333; 337/362; 337/380; 337/377; 337/417

[58] Field of Search ..... 337/29, 343, 365, 337/348, 380, 379, 377, 335, 333, 334, 102, 103, 104, 105, 106, 107; 361/23, 24, 25, 26, 27, 103, 105, 106, 32

[56] References Cited

U.S. PATENT DOCUMENTS 3,430,177 2/1969 Audette .
4,849,729 7/1989 Hofsäss .
5,023,744 6/1991 Hofsass ..... 361/26
5,434,388 7/1995 Kralik et al. .
5,670,930 9/1997 Hofsäss et al. .

FOREIGN PATENT DOCUMENTS 0342441 11/1989 European Pat. Off. .
0651411 5/1995 European Pat. Off. .
1690301 9/1971 Germany .
4142716 6/1993 Germany .
4233676 4/1994 Germany .
4337141 5/1995 Germany .

*Primary Examiner*—Leo P. Picard
*Assistant Examiner*—Anatoly Vortman
*Attorney, Agent, or Firm*—Harness, Dickey & Pierce, P.L.C.

[57] ABSTRACT

A temperature controller comprises a bimetallic switching mechanism that switches in response to a predetermined temperature, a lower housing part receiving the switching mechanism, a cover part closing off the lower housing part, and a substantially inert film that is arranged between the lower housing part and the cover part. The substantially inert film comprises a polyimide. The film comprises a mechanical seal between the lower housing part and the cover part.

11 Claims, 2 Drawing Sheets

TEMPERATURE CONTROLLER HAVING A POLYIMIDE FILM

BACKGROUND OF THE INVENTION

1. Field of the Invention

The present invention relates to a temperature controller having a bimetallic switching mechanism that switches in response to a predetermined temperature, a lower housing part receiving the switching mechanism, a cover part closing off the lower housing part, and a substantially inert polyimide film that is arranged between the lower housing part and the cover part.

2. Discussion

Temperature controllers of this kind are known from the related art. In the case of the known temperature controllers, the lower housing part and the cover part are made of conductive material, preferably of metal, so that they are very stable and pressure-resistant.

As a rule, the bimetallic switching mechanism comprises a spring disk that is braced at its rim against the bottom of the lower housing part and carries in its center a movable contact element which it presses against the inside of the cover part, where a fixed countercontact is arranged. A bimetallic snap disk, which below its switching temperature rests unconstrainedly on the spring disk, is slipped over the moving contact element. Contact to a temperature controller of this kind is made via the cover part and the lower housing part, the current flowing from the cover part through the countercontact and the spring disk to the lower housing part.

If the temperature of the bimetallic snap disk increases impermissibly, it snaps over from its convex shape into a concave shape, in which it lifts the movable contact element away from the countercontact against the force of the spring disk and thus opens the circuit. It is necessary for this purpose that the cover part be insulated with respect to the lower housing part, which is accomplished by means of a substantially inert polyimide film.

The substantially inert polyimide film of the present invention also covers the inner side of the cover part, so that the bimetallic snap disk which, in its high temperature position, is braced at its rim cannot produce a short-circuit between the cover part and the spring disk.

It is known to use, instead of the substantially inert polyimide film, a different insulating film that can be made, for example, of a polyamide or aramide paper or of polytetrafluoroethylene. The thickness of the substantially inert polyimide film in one embodiment is 75 micrometers, this thickness being determined by the desired electric strength. It should be mentioned that in the open-circuit state, there is a voltage drop across the substantially inert polyimide film which can correspond to the level of the mains voltage.

It is advantageous for the operation of the temperature controller as described so far that no dust, moisture, or liquid get into the interior of the temperature controller, so as to prevent any impairment of the function of the bimetallic switching mechanism. Dust and liquid can, for example, result in undesirable tracking currents or insulated areas which can negatively influence the reliable operation of the temperature controller. Damage to the switching mechanism can also occur.

In order to achieve the required sealing, in the related art the temperature controller, equipped with connecting leads, is encased with epoxy, silicone, or other encasing compounds, either entirely or only on the surfaces at which there are opportunities for dust, water, oil, etc. to penetrate. These encasing operations require additional cost-intensive operations.

It is furthermore known to slide heat-shrink tubing over the temperature controllers, once they have been equipped with connecting leads, in order to achieve electrical insulation.

SUMMARY OF THE INVENTION

In view of the above, it is an object of the present invention to improve the temperature controller mentioned at the outset, with a physically simple design, in such a way that provision is made in economical fashion for good sealing between the lower housing part and the cover part.

In the case of the temperature controller mentioned at the outset, this object is achieved, according to the invention, by the fact that the substantially inert polyimide film, which preferably has a thickness that is greater than 100 micrometers, comprises a mechanical seal between the lower housing part and the cover part, the cover part, with its rim, preferably compressing the substantially inert polyimide film in its contact region between the rim and a shoulder of the lower housing part.

The present invention is a temperature controller which comprises a bimetallic switching mechanism that switches in response to a predetermined temperature, a lower housing part receiving the switching mechanism, a cover part closing off the lower housing part, and a substantially inert film that is arranged between the lower housing part and the cover part. The substantially inert film comprises a polyimide. The film comprises a mechanical seal between the lower housing part and the cover part.

The object underlying the invention is achieved in this manner. Specifically, the inventors of the present application have recognized that, surprisingly, the substantially inert polyimide film can be used not only for electrical insulation, but moreover also for sealing between cover part and lower housing part. This is attributable to the fact that the substantially inert polyimide film is made from a nonporous and non-linting material, which moreover has a certain elasticity so that it can be compressed to a specific degree. Until now, such compression of the substantially inert polyimide film was always avoided during final assembly of the known temperature controllers so that the thickness required for the desired electric strength was retained.

According to the invention, the substantially inert polyimide film is preferably designed to be at least 25 micrometers thicker than was the case in the related art, so that it can be compressed by that amount (25 micrometers) in the contact region between the rim of the cover part and the shoulder of the lower housing part. Outside the contact and compression region, the original thickness of the substantially inert polyimide film is more or less retained, so that the overall result is a very good seal between cover part and lower housing part.

This local compression of the substantially inert polyimide film is possible, based on the inventors' recognition, because in addition to the necessary elasticity, it has the further advantage that when thus compressed it does not give off small particles, lint, etc. which might get into the interior of the temperature controller and there lead to an impairment of operating reliability.

The inventors of the present application have recognized for the first time that these properties of the substantially inert polyimide film make it possible, with a suitable design, to use the substantially inert polyimide film not only for electrical insulation, but additionally/alteratively for sealing against dust and moisture or liquid. The thickness is selected, in this context, so that any electric strength which may be required is achieved.

The present invention thus also concerns the use of a substantially inert polyimide film, having a thickness preferably greater than 100 micrometers, for dust- and liquid-tight sealing between a lower housing part and a cover part, which closes off the latter, of a temperature controller which has a bimetallic switching mechanism that is arranged in the lower housing part and switches in the presence of overtemperature, the lower housing part and the cover part preferably being made of conductive material, particularly preferably of metal.

The advantages of this use have already been described in detail above.

In an embodiment, it is preferred if the cover part has on its inner side a peripheral bead or ridge in the region of the rim which at least partially constricts the substantially inert polyimide film in the vicinity of the contact region, the bead preferably having a thickness that is greater than 20 micrometers.

The advantage here is that an even better mechanical seal is achieved by the fact that the bead, so to speak, penetrates partly into the material of the substantially inert polyimide film, and acts as a kind of sealing lip. By selecting the thickness of the substantially inert polyimide film on the one hand and the thickness of the bead or sealing lip on the other hand, provision can be made here on the one hand for the required electric strength to be maintained, while on the other hand a sufficient penetration depth can be achieved so that the desired mechanical seal can also be attained.

As compared with the more planar deformation, described above, of the substantially inert polyimide film in the contact region between the rim of the cover part and the shoulder of the lower housing part, the feature of the peripheral bead offers firstly the advantage that by selecting the thicknesses as described above, provision can be made for maintaining the dielectric strength. The reason is that the force required in order to press the bead into the substantially inert polyimide disk is less than the force required in order to compress the substantially inert polyimide film in the entire contact region. It is thus possible, by selecting the force required when flanging the lower housing parts together, to ensure that while the bead penetrates into the substantially inert polyimide film and comprises a mechanical sealing, nevertheless no further, in particular no impermissible, deformation of the substantially inert polyimide film takes place.

While the substantially inert polyimide film deformed in the entire contact region yields the advantage that the deformation takes place over a larger area and thus ensures very good sealing, this good sealing is achieved, in the case of the embodiment with the bead, by the fact that the latter penetrates into the substantially inert polyimide material like a kind of sealing lip. Of course the two features can also be used in combination.

Further advantages are evident from the description and from the attached drawings. It is understood that the features mentioned above and those yet to be explained below can be used not only in the respective combinations indicated, but also in other combinations or in isolation, without leaving the context of the present invention.

BRIEF DESCRIPTION OF THE DRAWINGS

The invention is shown in the drawings and will be explained further in the description which follows. In the drawings.

DETAILED DESCRIPTION OF PREFERRED EMBODIMENTS

Figure 1:
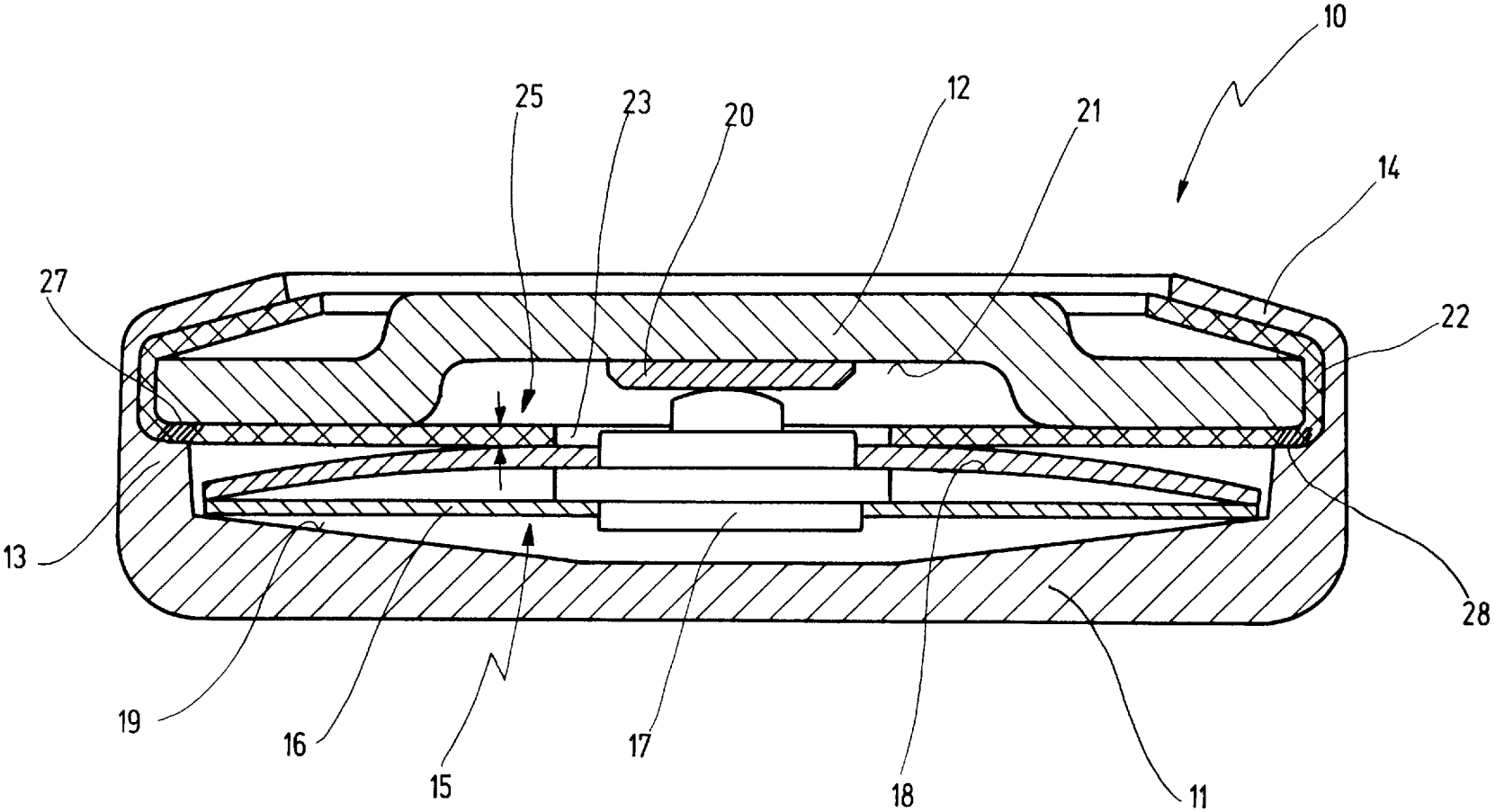
FIG. 1 shows a new temperature controller in a sectioned side view, in which the substantially inert polyimide film is deformed (not visible) in the region of its contact surface.

FIG. 1 shows, in an axial section, an embodiment of the new temperature controller 10. Temperature controller 10 comprises a cup-shaped lower housing part 11 and a cover part 12, closing off lower housing part 11, that rests on an internally peripheral shoulder 13 of lower housing part 11. Temperature controller 10 is closed off by means of a crimped rim 14 of lower housing part 11 which presses cover part 12 onto peripheral shoulder 13.

A bimetallic switching mechanism 15 of ordinary design is located in the interior of lower housing part 11. It comprises a spring disk 16 which carries a movable contact element 17 over which a bimetallic snap disk 18 is slipped. Spring disk 16 is braced against an inner bottom 19 of the cup-shaped lower housing part, and thus preloads movable contact element 17 against a fixed contact element 20 that is provided on cover part 12 on its inner side 21.

In this temperature controller 10, lower housing part 11 and cover part 12 are made of conductive material, preferably of metal, so that a substantially inert polyimide film 22 is provided which electrically insulates cover part 12 with respect to lower housing part 11. Contact is made to temperature controller 10 on the one hand via cover part 12 and on the other hand via lower housing part 11.

In the preferred embodiment, film 22 comprises a polyimide film such as a Kapton® film which is commercially available from du Pont. Several grades exist for Kapton, including, for example, 50HN, 75HN, 100HN, 200HN, 300HN, 500HN, 50VN, 75VN, 100VN, 200VN, 300VN, 500VN, as well as HPP-ST and FN grades. It will be appreciated by the skilled artisan that the preferred selection of the grade of Kapton is a finction of the particular application within which the film is to be employed and the desired thickness of the film.

Also evident from FIG. 1 is the fact that film 22 extends over the entire inner side 21 of cover part 12, an opening 23 being provided through which movable contact element 17 projects. Film 22 has a thickness, indicated at 25, which is greater than 100 micrometers and is preferably 125 micrometers. Because of this thickness 25, cover part 12 can be pressed with its rim 27, by crimped rim 14, onto film 22 in its contact region 28 and onto rim 13 in such a way that contact region 28 is at least partially compressed. This compressed contact region 28 is indicated in FIG. 1, but for depiction-related reasons the change in thickness 25 in this region is not evident.

Since film 22 is made of an elastic, lint-free material that moreover is nonporous, a good mechanical seal can exist in this fashion between cover part 12 and lower housing part 11. Compression of contact region 28 results in a particularly good mechanical seal, so that neither dust nor liquid or moisture can penetrate into the interior of temperature controller 10. Of course it is not necessary for cover part 12 and lower housing part 11 to be made of electrically conductive material; other designs are also possible, in which, for example, cover part 12 is made of electrically insulating material, and fixed contact element 20 extends in the manner of a rivet through cover part 12 and has contact made to it from outside.

In an embodiment of this kind, film 22 takes on only the function of mechanical sealing, since electrical insulation is not necessary. In the state shown in FIG. 1, switching mechanism 15 is at a temperature below its response temperature, so that it is in the closed state in which it provides a conductive connection between fixed contact element 20 and thus electrically conductive cover part 12, and bottom 19 and thus electrically conductive lower housing part 11.

If the temperature of switching mechanism 15 is then increased, bimetallic snap disk 18 suddenly snaps over from the convex shape shown to a concave shape, and is braced against the underside of cover part 12, with film 22 interposed, in such a way that it lifts the movable contact element away from fixed contact element 20 against the force of spring disk 18.

Figure 2:
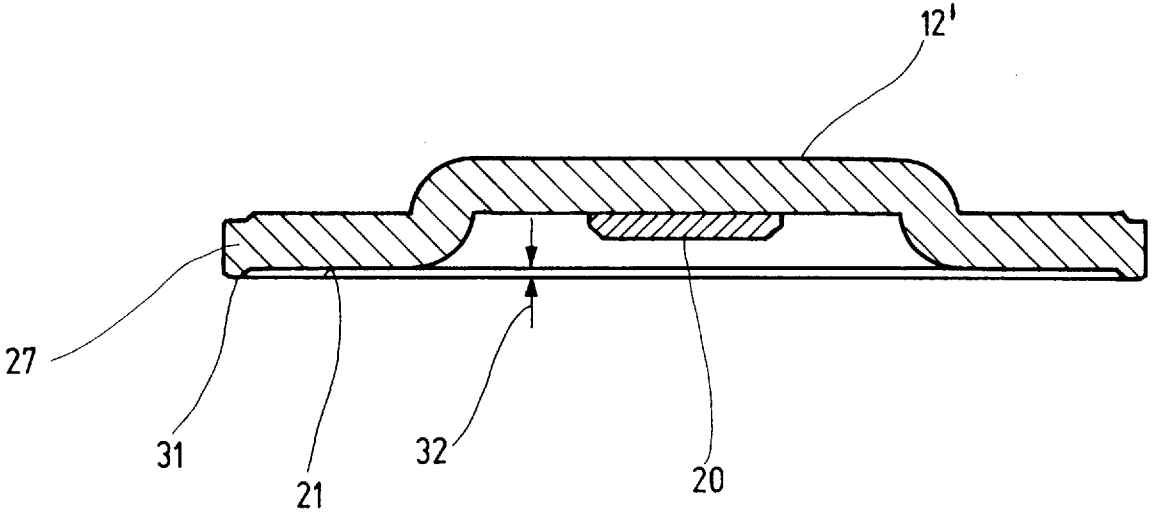
FIG. 2 shows an alternative cover part that can be used with the temperature controller of FIG. 1.

FIG. 2 shows an alternative cover part 12' that can be used in the new temperature controller of FIG. 1. The alternative cover part 12' has, in the region of its rim 27 on the inner side 21, a bead 31 or ridge which has a thickness, indicated at 32, which is greater than 20 micrometers, preferably 30 micrometers. In the assembled state, bead 31 presses in the manner of a sealing lip into the material of film 22 in the vicinity of contact region 28, thus ensuring a mechanical seal between cover part 12' and lower housing part 11.

Thickness 25 of film 22 and thickness 32 of bead 31 are adjusted to one another so that after crimped rim 14 is crimped over, the residual thickness of film 22 remaining in the region of bead 31 is still sufficient to provide for the necessary electric strength. On the other hand, thickness 32 is selected so that mechanical sealing is particularly good.

The embodiments which have been set forth above were for the purpose of illustration and were not intended to limit the invention. It will be appreciated by those skilled in the art that various changes and modifications may be made to the embodiments discussed in the specification without departing from the spirit and scope of the invention as defined by the appended claims.

What is claimed is:

1. A temperature controller comprising:

a bimetallic switching mechanism that switches in response to a predetermined temperature;

a lower housing part receiving the switching mechanism;

a cover part closing off the lower housing part, and having a rim and on its inner side a peripheral bead in the region of the rim;

and a substantially inert film that is arranged between the lower housing part and the cover part, said film comprising a polyimide and having a thickness which is greater than 100 micrometers;

wherein the film comprises a mechanical seal between the lower housing part and the cover part at the contact region between said lower housing part and said cover part, whereby said bead at least partially constricts the film in the vicinity of the contact region by pressing into the material of the film to thereby provide a tight seal between the cover part and the lower housing part.

2. The temperature controller of claim 1, wherein the film comprises Kapton.

3. The temperature controller of claim 1, wherein the bead has a thickness that is greater than 20 micrometers.

4. The temperature controller of claim 1, wherein the lower housing part and the cover part are made of conductive material.

5. The temperature controller of claim 4, wherein the lower housing part and the cover part are made of metal.

6. Use of a substantially inert film for dust-tight and liquid-tight sealing between a lower housing part and a cover part of a temperature controller which has a bimetallic switching mechanism that is arranged in the lower housing part and switches in response to a predetermined temperature, the cover part having on its inner side a peripheral bead in the region of the rim which at least partially constricts the film in the vicinity of the contact region between the lower housing part and the cover part by pressing into the material of the film, said film closing off the cover part and comprising a polyimide.

7. The use of claim 6, wherein the film comprises Kapton.

8. The use of claim 6, wherein the film has a thickness greater than 100 micrometers.

9. The use of claim 8, wherein the lower housing part and the cover part are made of conductive material.

10. The use of claim 9, wherein the lower housing part and the cover part are made of metal.

11. The use of claim 6, wherein the cover part has on its inner side a peripheral bead in the region of the rim which at least partially constricts the film in the vicinity of the contact region.

* * * * *